US007621000B1

(12) United States Patent
Fulton

(10) Patent No.: US 7,621,000 B1
(45) Date of Patent: Nov. 24, 2009

(54) HEADGEAR FOR ATTACHING A TOY

(76) Inventor: Brian K. Fulton, 11 W. Hartranft Blvd., East Norriton, PA (US) 19401

( * ) Notice: Subject to any disclaimer, the term of this patent is extended or adjusted under 35 U.S.C. 154(b) by 142 days.

(21) Appl. No.: 11/784,938

(22) Filed: Apr. 10, 2007

(51) Int. Cl.
*A42B 1/24* (2006.01)

(52) U.S. Cl. ..... 2/209.13; 2/209.12; 2/195.1

(58) Field of Classification Search ..... 2/209.13, 2/209.11, 109.12, 175.1, 195.1, 195.2, 10; D2/865, 891, 895
See application file for complete search history.

(56) References Cited

U.S. PATENT DOCUMENTS

| | | | | |
|---|---|---|---|---|
| 4,090,232 | A | 5/1978 | Golden | |
| 4,231,079 | A | 10/1980 | Heminover | |
| 5,111,366 | A | 5/1992 | Rife et al. | |
| 5,570,946 | A | 11/1996 | Chien | |
| 5,768,714 | A | 6/1998 | Bowhey | |
| D403,139 | S * | 12/1998 | Hunter | D2/866 |
| D404,892 | S * | 2/1999 | O'Brien | D2/872 |
| 5,887,287 | A | 3/1999 | Potochnik | |
| 6,126,507 | A | 10/2000 | Lieberman | |
| 6,170,087 | B1 | 1/2001 | Brannon | |
| 6,170,088 | B1 * | 1/2001 | Tate | 2/209.13 |
| 6,265,984 | B1 | 7/2001 | Molinaroli | |
| 6,279,167 | B1 * | 8/2001 | Johnson et al. | 2/209.13 |
| 6,659,618 | B2 | 12/2003 | Waters | |
| 6,719,437 | B2 * | 4/2004 | Lary et al. | 362/106 |
| 6,721,962 | B1 * | 4/2004 | Polaire | 2/209.13 |
| 6,733,150 | B1 * | 5/2004 | Hanley | 362/106 |
| 6,837,590 | B2 | 1/2005 | Marston | |
| 6,994,445 | B1 * | 2/2006 | Pomes | 362/106 |
| 7,044,615 | B2 * | 5/2006 | Gesten | 362/106 |
| 7,111,956 | B2 * | 9/2006 | Brown | 362/106 |
| 7,182,478 | B2 * | 2/2007 | Marston | 362/106 |
| 7,234,831 | B1 * | 6/2007 | Hanley | 362/106 |
| 7,284,284 | B2 * | 10/2007 | Wysopal | 2/209.13 |

* cited by examiner

*Primary Examiner*—Gary L Welch
*Assistant Examiner*—Sally Colson Cline
(74) *Attorney, Agent, or Firm*—P. Jeff Martin; The McGougan Law Firm, LLC

(57) ABSTRACT

A headgear apparatus in the design of a baseball style cap is provided having an attachment means adapted to removably hold a toy miniature car atop the brim thereof. The apparatus includes a light source for directing narrow beams of light forwardly from the forward peripheral edge of the brim of the headgear.

2 Claims, 5 Drawing Sheets

HEADGEAR FOR ATTACHING A TOY

RELATED APPLICATIONS

The present invention was first described in Disclosure Document No. 610,810 filed on Jan. 3, 2007 under 35 U.S.C. §122, 37 C.F.R. §1.14, and MPEP §1706. It is respectfully requested that said Disclosure Document remain a permanent part of the file history of the present application and be relied upon during the pending prosecution, and for any other matters that may arise concerning said present application and the subject matter contained therein. There are no previously filed, nor currently any co-pending applications, anywhere in the world.

BACKGROUND OF THE INVENTION

1. Field of the Invention

The present invention relates generally to headwear or headgear, and more particularly, to a headgear apparatus adapted to have a toy removably attached thereto.

2. Description of the Related Art

Recently, it has become very popular to place sports team emblems, logos and other designs and decor on the front of hats or caps above the brim. Typically, these caps have patches and similar articles permanently attached to the crown thereof via stitching. In addition, incorporating the use of lights and other illuminating devices with hats has been taught in the prior art. However, these prior illuminated headwear devices have required intrusive alterations and/or additions for the lights resulting in changes in comfort and fit afforded by conventional caps. Furthermore, the prior art has failed to teach a headgear apparatus adapted to have a toy removably attached thereto and a light source for directing narrow beams of light forwardly from the forward peripheral edge of brim.

Accordingly, a need has arisen for a headgear device adapted to have a toy removably attached thereto, and which includes a light source for directing narrow beams of light forwardly from the forward peripheral edge of the brim in a manner which is quick, easy, and efficient. The development of the headgear apparatus with removably attachable toy fulfills this need.

A search of the prior art did not disclose any patents that read directly on the claims of the instant invention; however, the following references were considered related.

U.S. Pat. No. 5,570,946, issued in the name of Chien discloses protective headwear having a super-thin lighting element attached thereto.

U.S. Pat. No. 5,887,287, issued in the name of Potochnik discloses a headwear with pocket(s), a veil, and an outside grasping member.

U.S. Pat. No. 6,126,507, issued in the name of Lieberman discloses a reversible doll/hat that can be converted from a hat to a doll and back to a hat.

U.S. Pat. No. 6,170,087 B1, issued in the name of Brannon discloses various article storage systems for hats allowing for the storage of relatively flat and unobtrusive articles on and within a hat.

U.S. Pat. No. 5,768,714, issued in the name of Bowhey discloses a toy vehicle and helmet combination.

U.S. Pat. No. 4,090,232, issued in the name of Golden discloses an illumination means for being worn about a person's head to direct a beam of light in the direction the person is looking.

U.S. Pat. No. 6,265,984 B1, issued in the name of Molinaroli discloses a pre-programmed device for forming and displaying images, comprising electrically powered light emitters which are under the direct control of a microprocessor, such that graphics, text, or other images are displayed when the display device is moved at or above a rate of speed sufficient to be viewed by humans.

Consequently, a need has been felt for a headgear device adapted to have a toy removably attached thereto, and which includes a light source for directing narrow beams of light forwardly from the forward peripheral edge of the brim in a manner which is quick, easy, and efficient.

SUMMARY OF THE INVENTION

Therefore, it is an object of the present invention to provide a headgear apparatus adapted to have a toy removably attached thereto.

It is another object of the present invention to provide a headgear apparatus in the design of a baseball style cap having an attachment means adapted to removably hold a toy die-cast miniature, metal car atop the brim thereof in a snap-fit manner.

It is another object of the present invention to provide a light source for directing narrow beams of light forwardly from the forward peripheral edge of brim.

It is another object of the present invention to provide a rear mounted push-button switch coupled to light source.

It is still another object of the present invention to provide a push-button switch adapted to facilitate manual activation of light source such that narrow beams of light are continuously directed forwardly from the forward peripheral edge of the brim.

Briefly described according to one embodiment of the present invention, a headgear apparatus with removably attachable toy is described, the headgear apparatus comprising a "baseball" style cap or hat, having a generally hemispherical crown that is sewn or otherwise attached by other devices to a band. The hat may also be in the style of a fishing cap, or any other hat/cap that employs a brim.

The crown may be formed from a breathable fabric such as cotton or canvas. The band includes an adjustable device which adapts to varying head sizes or band may be of a fitted type to accommodate a person's head by one skilled in the art. A brim or visor extends from a front portion of the hat. The brim is fabricated of an injection molded, lightweight, rigid plastic or polymeric material. Brim includes a support panel formed integral therewith and which extends upwardly from a rearward edge thereof at an angular orientation.

An attachment means is provided, wherein attachment means is adapted to facilitate the removable attachment of a toy to the brim of the hat. More specifically, the attachment means is adapted to removably hold a toy die-cast miniature, metal car atop the brim in a snap-fit or mechanical interferential manner. A magnet may be disposed within a cavity of brim in order to augment the attachment of toy car to brim.

A light source is provided for directing narrow beams of light forwardly from the forward peripheral edge of brim. The light source is preferably high-intensity lights or light emitting diodes (LEDs), and more specifically, high-intensity white LEDs. The LEDs have a transparent or translucent plastic lens body. The light source is disposed within the forward peripheral edge of brim. A push-button switch is coupled to light source, wherein push-button switch is adapted to facilitate manual activation of light source such that narrow beams of light are continuously directed forwardly from the forward peripheral edge of brim.

The use of the present invention provides a headgear device adapted to have a toy removably attached thereto, and a light source for directing narrow beams of light forwardly from the forward peripheral edge of the brim in a manner which is quick, easy, and efficient.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

1. Detailed Description of the Figures

Figure 1:
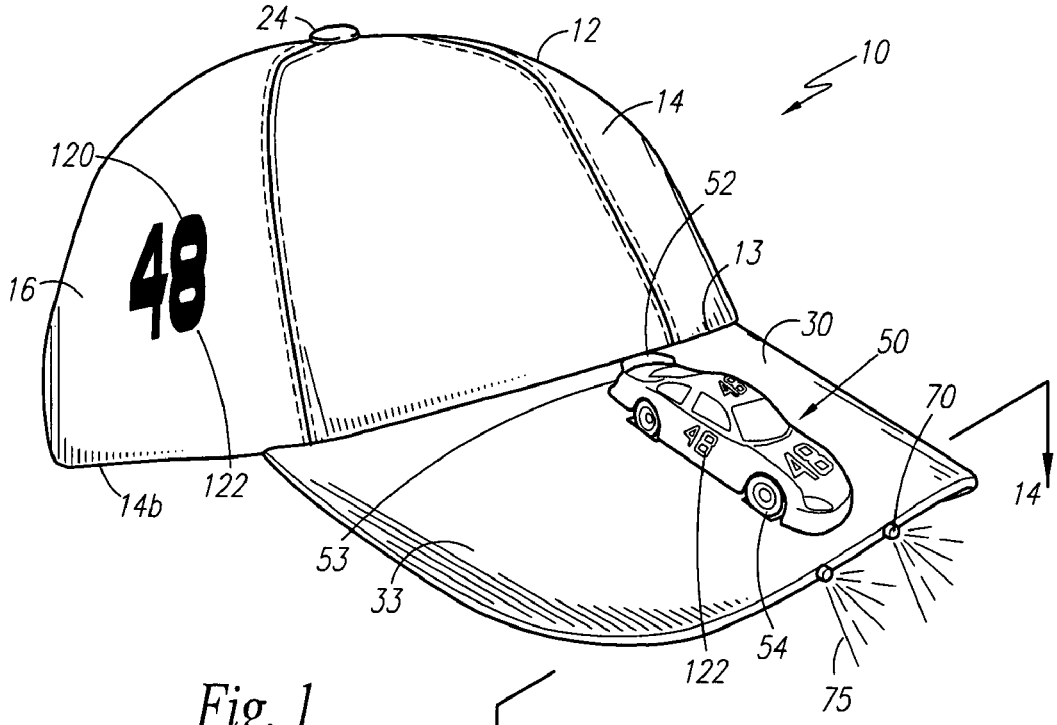
FIG. 1 is a perspective view of a headgear apparatus with removably attachable toy, according to the preferred embodiment of the present invention.
Figure 2:
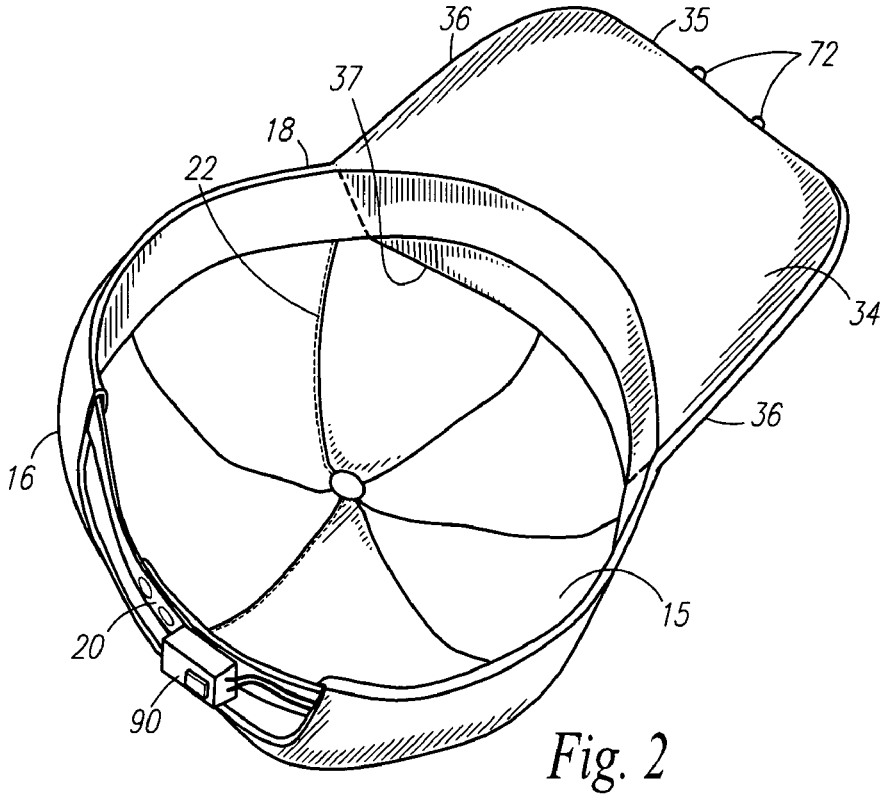
FIG. 2 is a bottom perspective view thereof, illustrating an interior of a baseball style cap, showing the attachment of the support panel of brim to the crown.
Figure 3:
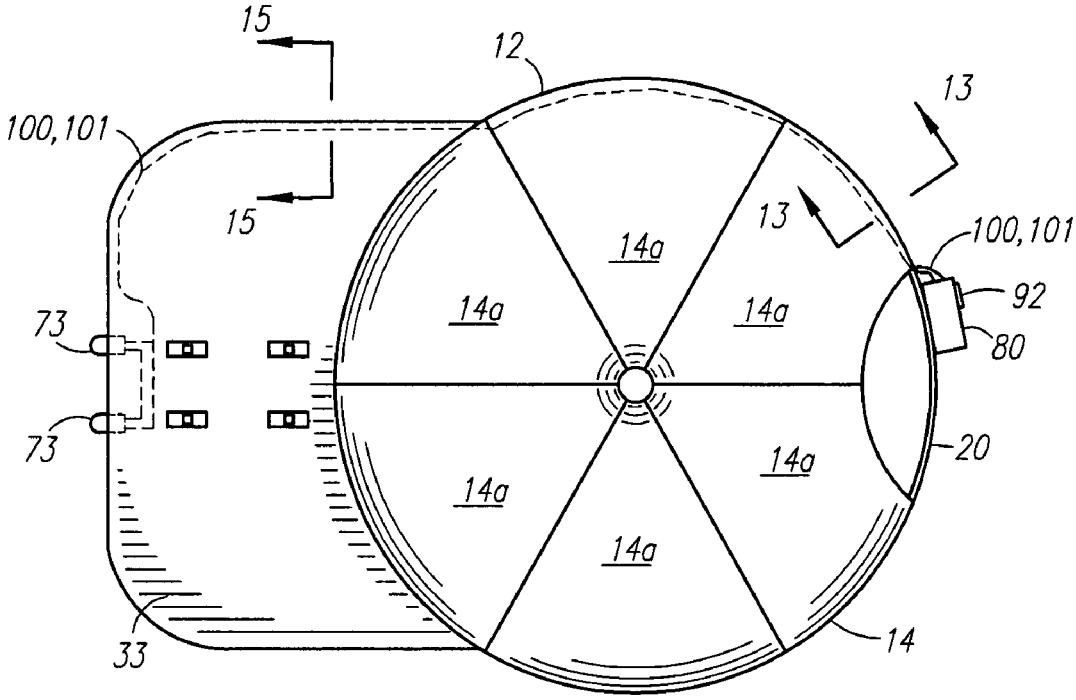
FIG. 3 is a top plan view of the headgear apparatus of FIG. 1 showing a rear mounted housing with wire conductors interconnecting the LEDs and housing shown in phantom.

Referring now to FIGS. 1-3, a headgear apparatus 10, according to the present invention, is shown comprised of a hat 12 comprising a "baseball" style cap, having a generally hemispherical crown 14 that is sewn or otherwise attached by other devices to a band 18. The hat 12 may also be in the style of a fishing cap, or any other hat/cap 12 that employs a brim 30. The crown 14 can be formed with no band by one skilled in the art that is adapted to fit suitably to the users head dependent upon materials utilized. The crown 14 includes an inner surface 15 and an outer surface 16. The crown 14 may be formed from a breathable fabric such as cotton or canvas. The band 18 includes an adjustable device 20 which adapts to varying head sizes or band 18 may be of a fitted type to accommodate a person's head by one skilled in the art. The crown 14 is formed of several individual panels 14*a* stitched 22 together or otherwise sealed or secured at edges thereof from a button 24 downward to the bottom portion 14*b* of the crown 14 to comprise the entire crown 14. A brim 30 or visor extends from a front portion 13 of the hat 12 that is suitably attached to the band 18 and/or crown 14.

Figure 4:
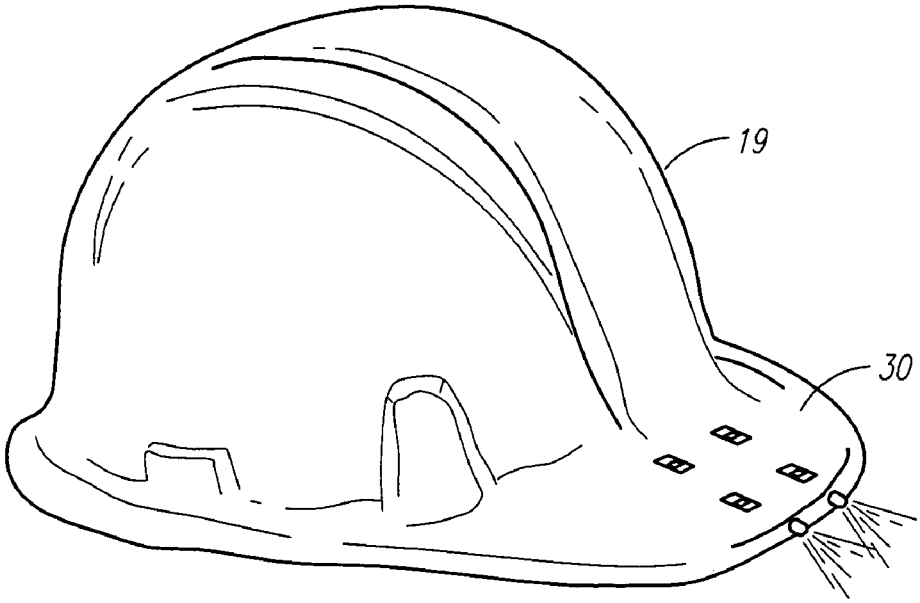
FIG. 4 shows a protective helmet in accordance with the present invention.
Figure 5:
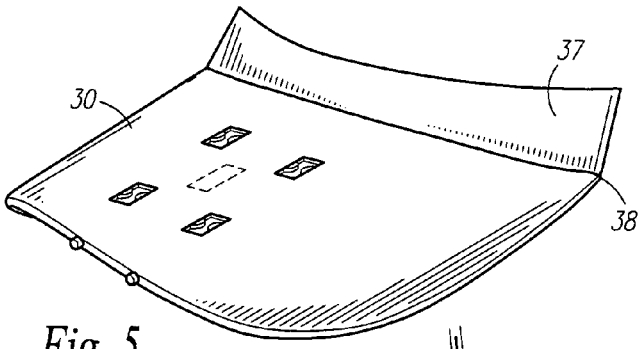
FIG. 5 is a perspective view of the brim, according to the preferred embodiment of the present invention.
Figure 6:
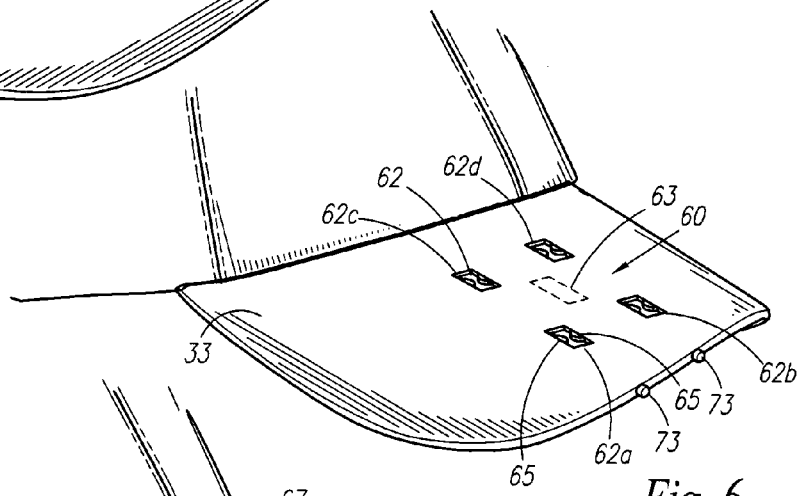
FIG. 6 is a partial perspective view of the headgear apparatus illustrating the attachment mechanism for removably attaching a toy to the brim thereof.

While the present invention is illustrated as a "baseball" style cap, the present invention is equally adaptable to other types of headgear as well, such as a protective helmet 19, shown in FIG. 4.

Referring now more specifically to FIGS. 1-3, 5, and 14, the brim 30 is fabricated of an injection molded, lightweight, rigid plastic or polymeric material. The brim 30 includes an upper surface 33 opposing a lower surface 34, a forward peripheral edge 35, and continuously extending side edges 36. Brim 30 further includes a support panel 37 formed integral therewith and which extends upwardly from a rearward edge 38 of brim 30 at an angular orientation. As shown in FIG. 2, the support panel 37 of brim 30 is suitably attached between the band 18 and inner surface 15 of crown 14. Brim 30 is illustrated as having a curved shape, however, brim 30 can have a flat or planar shape.

Referring now more specifically to FIGS. 1,3,5, and 6, in order to removably attach a toy 50 to the brim 30, an attachment means or mechanism 60 is provided. The attachment mechanism 60 preferably comprises a plurality of generally rectangularly-shaped recesses 62 defined through the upper surface 33 of brim 30. The recesses 62 include a first pair of adjacently-aligned recesses 62*a*, 62*b* located proximal to the forward peripheral edge 35 of brim, and a second pair of adjacently-aligned recesses 62*c*, 62*d* located rear of recesses 62*a*, 62*b*. Recess 62*a* is linearly aligned with respect to recess 62*c*, and likewise, recess 62*b* is linearly aligned with respect to recess 62*d*. Recesses 62*a*, 62*b*, 62*c*, and 62*d* are adapted and dimensionally configured so as to accommodate the wheelbase or wheels 54 of a toy car 52, and specifically toy die-cast miniature, metal cars 53 or vehicles sold under the registered trademarks which include but are not limited to Hot Wheels®, Matchbox®, Johnny Lightning®, and Ertyl®. Each recess 62*a*, 62*b*, 62*c*, and 62*d* includes opposing impingement tabs 65 projecting integrally from inner sidewalls thereof. The impingement tabs 65 are adapted to removably hold the wheels 54 of the toy car 52 within the respective recesses 62*a*, 62*b*, 62*c*, 62*d* in a snap-fit manner, thereby removably attaching the toy car 52 to the brim 30 of the hat 12. Once the wheels 54 are inserted within respective recesses 62*a*, 62*b*, 62*c*, and 62*d*, the impingement tabs 65 function to apply an impinging force against an outer surface of the wheels 54, thereby temporarily removably attaching the toy car 52 to the upper surface 33 of brim 30.

A magnet 63 is centrally disposed between recesses 62*a*, 62*b*, 62*c*, and 62*d* in order to augment the attachment of toy car 52 to brim 30.

Figure 7:
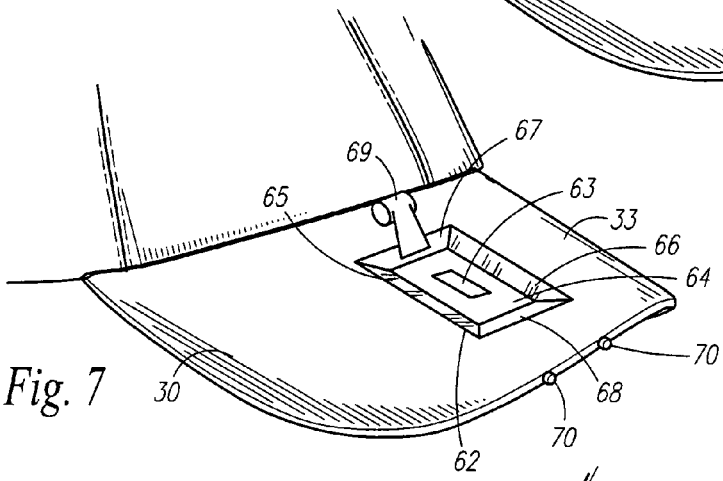
FIG. 7 is a partial perspective view of the headgear apparatus illustrating an alternate embodiment of the attachment mechanism.
Figure 8:
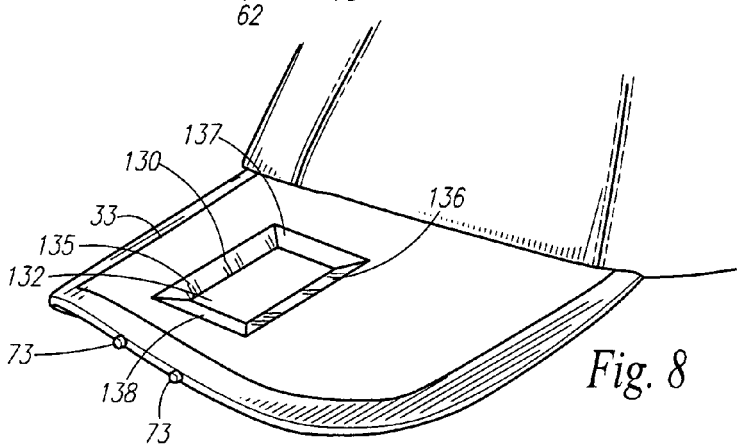
FIG. 8 is a top perspective view of a second alternate embodiment of the present invention showing the compartment thereof.
Figure 9:
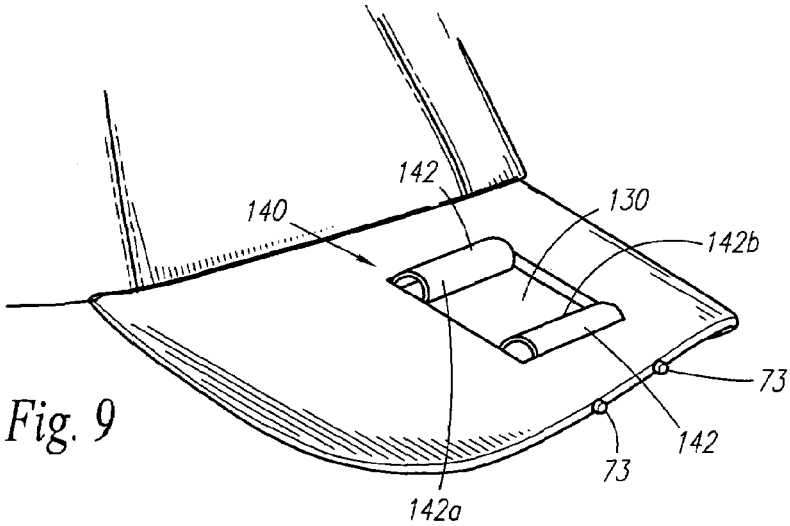
FIG. 9 is a top perspective view of the second alternate embodiment illustrating the attachment means thereof.
Figure 10:
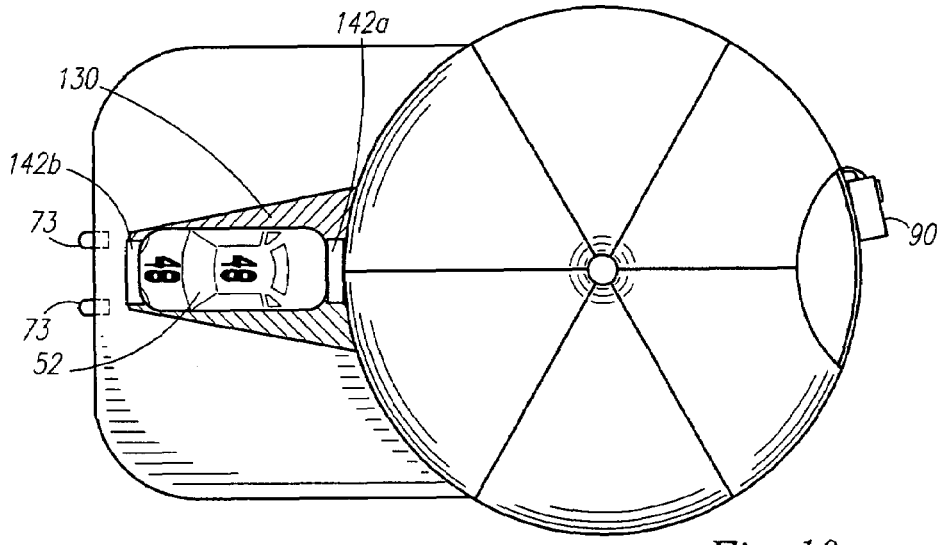
FIG. 10 is a top side view of the second alternate embodiment of the present invention.
Figure 11:
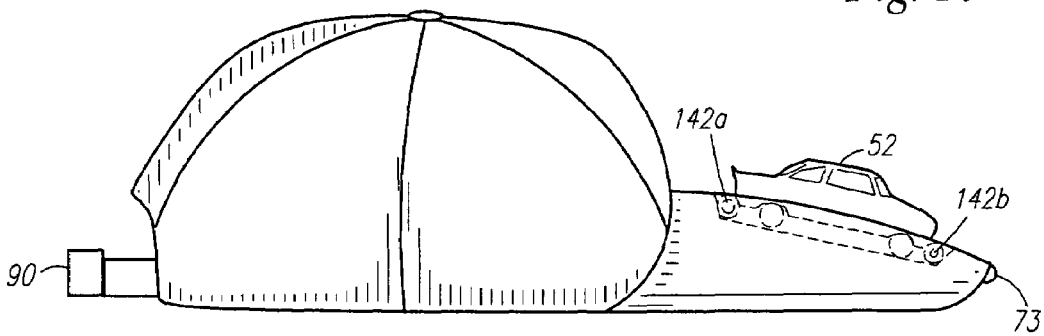
FIG. 11 is a side elevational view of the second alternate embodiment of the present invention showing a toy car nestled within the compartment thereof.
Figure 12:
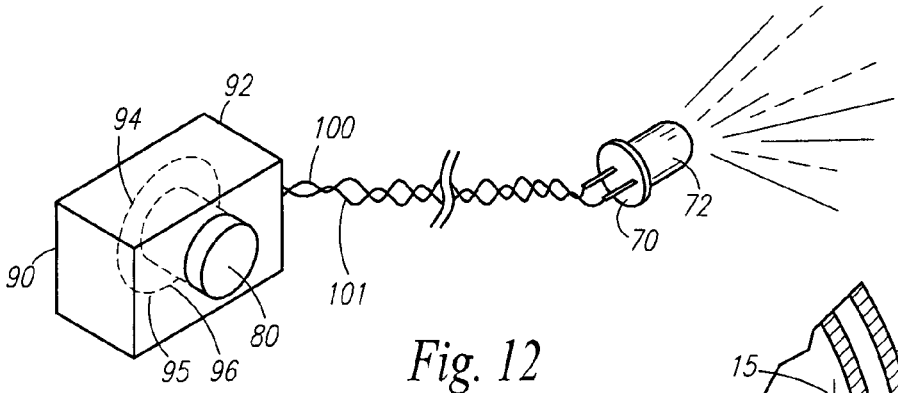
FIG. 12 is a perspective view of a housing showing the push-button switch thereof.
Figure 13:
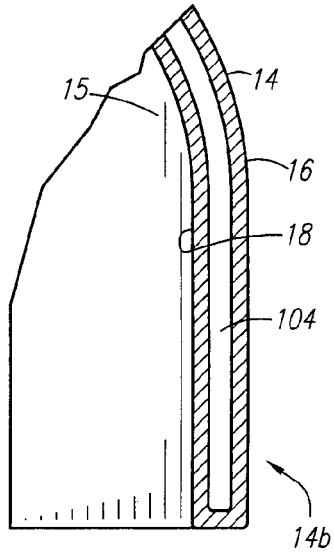
FIG. 13 is a fragmentary cross-sectional view taken along the line 13-13 of FIG. 3 showing the space through which wire conductors extend from the housing and travel through between the band and the inner surface of the crown.

Referring now to FIG. 7, in accordance with an alternate embodiment of the present invention, the upper surface 33 of brim 30 includes a rectangularly-shaped compartment 62 defined therein and having an inclined or sloped floor 64. The compartment 62 includes opposing vertical sidewalls 65,66 and opposing horizontal sidewalls 67, 68. The floor 64 defines an inclination in a direction from horizontal sidewall 67 to horizontal sidewall 68. The compartment 62 defines a depth of approximately ⅜ inch at horizontal wall 67 from which the floor 64 of compartment 62 elevates inclinationally to a depth of approximately ¼ inch at horizontal wall 68. The compartment 62 is dimensionally-adapted to snugly accommodate and retain a toy car 52 therein. A biasing clip 69 is mounted atop upper surface 33 of brim 30 about a rearward edge of compartment 62. In a resting position, the clip 69 is biased to a downward position, thereby serving to hold toy car 52 in place when car 52 is placed within compartment 62 below clip 69. A magnet 63 may be provided being centrally disposed within floor 64 in order to augment attachment of toy car 52 to brim 30.

Referring now to FIGS. 8-11, in accordance with a second alternate embodiment of the present invention, the upper surface 33 of brim 30 includes a rectangularly-shaped compartment 130 defined therein and having an inclined or sloped floor 132. The compartment 130 includes opposing vertical sidewalls 135, 136 and opposing horizontal sidewalls 137, 138. The floor 132 defines an inclination in a direction from horizontal sidewall 137 to horizontal sidewall 138. The compartment 130 defines a depth of approximately ⅜ inch at horizontal wall 137 from which the floor 132 of compartment 130 elevates inclinationally to a depth of approximately ¼ inch at horizontal wall 138. The compartment 130 is dimensionally-adapted to accommodate and snugly retain a toy car 52 therein in such a manner that upon insertion of toy car 52 within compartment 130, an upper hemisphere of toy car 52 is easily viewable when observing the present invention from a side view thereof.

An attachment means 140 in the form of a pair of elongated, tubular members 142 is provided. First tubular member 142*a* is suitably affixed horizontally between horizontal sidewall 137 and floor 132 of compartment 130. Second tubular member 142*b* is suitably affixed horizontally between horizontal sidewall 138 and floor 132 of compartment 130. First tubular member 142*a* and second tubular member 142*b* are fabricated of a lightweight, pliable material, such as polyurethane foam. The attachment means 140 is adapted to removably secure, attach, or hold toy car 52 within compartment 130 via frictional interference. More specifically, a posterior end of toy car 52 mechanically interferes with first tubular member 142*a* and an anterior end of toy car 52 mechanically interferes with second tubular member 142*b*, thereby removably holding toy car 52 within compartment 130.

Referring now to FIGS. 1-3, 6-11, and more particularly to FIGS. 12-15, a light source 70 is provided for directing narrow beams 75 of light forwardly from the forward peripheral edge 35 of brim 30. The light source 70 is preferably high-intensity lights or light emitting diodes (LEDs) 72, and more specifically, high-intensity white LEDs 73. The LEDs 72 have a transparent or translucent plastic lens body 72*a*. The light source 70 is disposed within the forward peripheral edge 35 of brim 30. A push-button switch 80 is coupled to light source 70, wherein push-button switch 80 is adapted to facilitate manual activation of light source 70 such that narrow beams 75 of light are continuously directed forwardly from the forward peripheral edge 35 of brim 30.

A housing 90 of a compact size is provided and mounted to the adjustable device 20 of hat 12 or other suitable area of hat 12. The housing 90 is comprised of a housing body 92 within which a power source 94 is disposed for powering light source 70. The power source 94 is coupled between push-button switch 80 and light source 70. The power source 94 is envisioned to include at least one small battery 95 with sufficient strength to power light source 70, such as a three volt coin cell 96. A pair of wire conductors 100, 101 extend from the housing 90 and travel through space 104 between the band 18 and the inner surface 15 of crown 14, and further extend within a channel 106 of brim 30 to the rear of the LEDs 72. The channel 106 extends along one of the side edges 36 and the forward peripheral edge 35.

Figure 14:
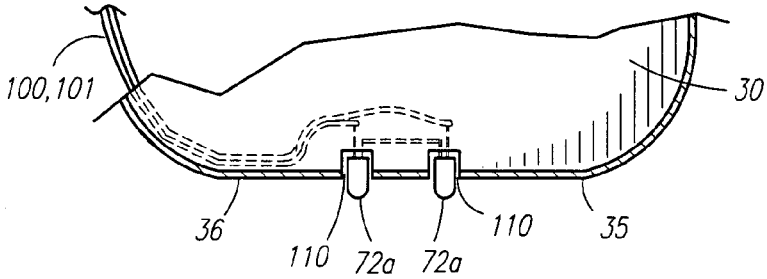
FIG. 14 is a fragmentary cross-sectional view taken along the line 14-14 of FIG. 1 showing notches formed in the forward peripheral edge of brim with the LEDs secured therein.
Figure 15:
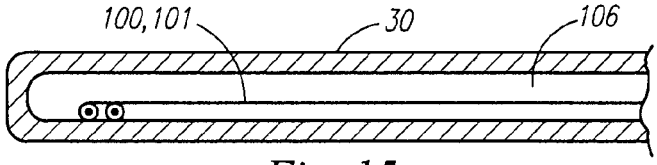
FIG. 15 is a fragmentary cross-sectional view taken along the line 15-15 of FIG. 3 showing the channel formed along one of the side edges and forward peripheral edge of brim through which wire conductors extend from between the band and the inner surface of the crown and travel to the rear of the LEDs.

A pair of laterally-spaced notches 110 are formed in the forward peripheral edge 35. The notches 110 are dimensionally-adapted so as to snugly receive the LEDs 72 and to allow the lenses 72*a* thereof to project therethrough, as shown in FIG. 14.

The housing body 92 houses the push-button switch 80. The push-button switch 80 is adapted such that the depression thereof facilitates manual activation of the LEDs 72 such that narrow beams 75 of light are continuously directed forwardly from the forward peripheral edge 35 of brim 30. Specifically, upon depression of push-button switch 80, the power source 94 energizes the LEDs 72. The push-button switch 80 is further adapted such that subsequent depression thereof facilitates manual deactivation of the LEDs 72 such that the LEDs 72 are turned off. Specifically, upon subsequent depression of push-button switch 80, the connection between the power source 94 and the LEDs 72 is broken, thus the LEDs 72 are turned off.

Upon removable attachment of the toy car 52 to brim 30 and upon activation of the LEDs 72, the combination of the attached toy 52 and illuminated LEDs 72 simulate vehicle headlight beams when present invention is viewed from the side or a forward end thereof.

Finally, referring to FIG. 1, the headgear apparatus 10 may be adorned with ornamentation 120 to represent and resemble in shape, color, and design the number 122 of a racecar which races competitively in auto racing series for racing purses such as NASCAR® NEXTEL Cup Series, NASCAR® BUSCH® Series, NASCAR® CRAFTSMAN® TRUCK Series, FIA World Rally cars, Formula I, and IRL®. More specifically, the outer surface 16 or at least one panel 14*a* of the crown 14 includes ornamentation defined as a number 122 that is sewn, adhered via adhesive, or otherwise suitably attached thereto. Scaled-down versions of racecars or toy die-cast miniature, metal cars 53 adapted to resemble cars which race competitively in auto racing series for racing purses such as NASCAR® NEXTEL Cup Series, NASCAR® BUSCH® Series, and NASCAR® CRAFTSMAN® TRUCK Series are commercially available. These metal cars 53 are sold under the registered trademarks which include Hot Wheels®, Matchbox®, Johnny Lightning®, and Ertyl®. Thus, it is envisioned that the toy die-cast miniature, metal car 53 which is removably attachable to the brim 30 of the hat 12 is adorned with a number 122 corresponding to a same number 122 adorning the outer surface 16 or at least one panel 14*a* of the crown 14. For example, as illustrated in FIG. 1, the car 53 is adorned with the number "48" which corresponds to or matches the number "48" provided on the outer surface 16 or the panel 14*a* of crown 14. It is therefore envisioned that a consumer may make headgear apparatus 10 purchase selection based upon a NASCAR® driver of choice or a NASCAR® racecar favorite.

2. Operation of the Preferred Embodiment

To use the present invention, user snaps the wheels 54 of a selected or desired toy die-cast miniature, metal car 53 within corresponding recesses 62*a*,62*b*, 62*c*, and 62*d* defined through the upper surface 33 of brim 30. In doing so, the car 53 is temporarily removably attached to the upper surface 33 of brim 30. User next presses the push-button switch 80 in order to facilitate manual activation of LEDs 72 such that narrow beams 75 of light are continuously directed forwardly from the forward peripheral edge 35 of brim 30. In order to deactivate the LEDs 72, user again depresses the push-button switch 80. In the event user desires to reactivate the LEDs 72, user simply depresses the push-button switch 80. User may continue to activate/deactivate LEDs 72 in this manner. Finally, user places hat 12 atop user's head.

The use of the present invention provides user with a headgear device adapted to have a toy removably attached thereto, and a light source for directing narrow beams of light forwardly from the forward peripheral edge of the brim in a manner which is quick, easy, and efficient.

Therefore, the foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be broadly limited only by the following Claims.

What is claimed is:

1. A headgear apparatus comprising:

a hat, said hat having a generally hemispherical crown, said crown includes an inner surface and an outer surface, said crown has a front portion from which a brim extends, said crown is sewn or otherwise suitably attached to a band, said brim is suitably attached to said band or said crown, said brim comprises an upper surface opposing a lower surface, a forward peripheral edge, and continuously extending side edges, said brim includes a support panel formed integral therewith and which extends upwardly from a rearward edge of said brim at an angular orientation, said support panel is suitably attached between said band and said inner surface of said crown, and wherein said upper surface of said brim includes a rectangularly-shaped compartment defined therein, said compartment having an inclined or sloped floor, said compartment includes opposing vertical sidewalls and opposing horizontal sidewalls;

an attachment means, said attachment means is adapted for removably securing a toy to said brim; and a light source, said light source is adapted for directing narrow beams of light forwardly from said forward peripheral edge of said brim, wherein said floor defines an inclination in a direction from a first horizontal sidewall to a second horizontal sidewall, wherein said compartment is dimensionally-adapted to accommodate and snugly retain a toy car therein in such a manner that upon insertion of the toy car within said compartment, an upper hemisphere of the toy car is easily viewable when observing said headgear apparatus from a side view thereof, and wherein said attachment means is comprised of a pair of elongated, tubular members, said pair of elongated, tubular members includes a first tubular member and a second tubular member, wherein said first tubular member is suitably affixed horizontally between said first horizontal sidewall and said floor of said compartment, said second tubular member is suitably affixed horizontally between said second horizontal sidewall and said floor of said compartment, said first tubular member and said second tubular member are fabricated of a lightweight, pliable material, said attachment means removably secures the toy car within said compartment via frictional interference.

2. The headgear apparatus of claim 1, wherein said light source has a transparent or translucent plastic lens body, said light source is disposed within said forward peripheral edge of said brim, said light source has a push-button switch coupled thereto, wherein said push-button switch facilitates manual activation of said light source such that said narrow beams of light are continuously directed forwardly from said forward peripheral edge of said brim.

* * * * *